US010413967B2

(12) United States Patent
Tausend et al.

(10) Patent No.: US 10,413,967 B2
(45) Date of Patent: Sep. 17, 2019

(54) METHOD FOR PRODUCING A SINTERED PART WITH HIGH RADIAL PRECISION, AND SET OF PARTS COMPRISING JOINING PARTS TO BE SINTERED

(71) Applicant: GKN Sinter Metals Engineering GmbH, Radevormwald (DE)

(72) Inventors: Alexander Tausend, Remscheid (DE); Kerstin Ziegler, Solingen (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 253 days.

(21) Appl. No.: 15/023,960

(22) PCT Filed: Sep. 19, 2014

(86) PCT No.: PCT/EP2014/002553
§ 371 (c)(1),
(2) Date: Mar. 22, 2016

(87) PCT Pub. No.: WO2015/043734
PCT Pub. Date: Apr. 2, 2015

(65) Prior Publication Data

US 2016/0207107 A1 Jul. 21, 2016

(30) Foreign Application Priority Data

Sep. 23, 2013 (DE) ..... 10 2013 015 677

(51) Int. Cl.
*B22F 3/10* (2006.01)
*B22F 5/10* (2006.01)
(Continued)

(52) U.S. Cl.
CPC ..... *B22F 3/1017* (2013.01); *B21K 1/06* (2013.01); *B21K 1/18* (2013.01); *B21K 31/00* (2013.01);
(Continued)

(58) Field of Classification Search
CPC .... B22F 7/06; B22F 7/062; B22F 5/08; B22F 5/10; B22F 5/106; B22F 3/24;
(Continued)

(56) References Cited

U.S. PATENT DOCUMENTS 4,783,898 A 11/1988 Kanamaru et al.
5,895,119 A * 4/1999 Miyasaka ..... B22F 7/002 384/279
(Continued)

FOREIGN PATENT DOCUMENTS

DE 102011117856 A1 5/2013
JP S5993803 A 5/1984
JP 2003014120 A 1/2003

OTHER PUBLICATIONS

PCT International Search Report for corresponding International Application No. PCT/EP2014/002553; dated Mar. 13, 2015.

*Primary Examiner* — Matthew P Travers
(74) *Attorney, Agent, or Firm* — Quarles & Brady LLP

(57) ABSTRACT

The invention relates to a method for producing a sintered part with a high radial precision. The sintered part is made of at least one first joining part to be sintered and a second joining part to be sintered, and the method has at least the following steps: joining the first joining part with the second joining part, and bringing about the high radial precision, having a step of deforming at least one radial deformation element which is preferably positioned so as to adjoin a joint contact zone, wherein the deformation of the radial deformation element is caused at least by means of a calibration tool and is carried out at least substantially as a plastic deformation of the radial deformation element. The invention further relates to a set of parts for joining the joining parts to be sintered into a sintered part with a high radial precision.

10 Claims, 6 Drawing Sheets

(51) Int. Cl.

| | |
|---|---|
| ***B22F 7/06*** | (2006.01) |
| ***B22F 3/24*** | (2006.01) |
| ***B22F 5/08*** | (2006.01) |
| ***B21K 1/06*** | (2006.01) |
| ***B21K 1/18*** | (2006.01) |
| ***B21K 31/00*** | (2006.01) |

(52) U.S. Cl.
CPC ..... *B22F 3/24* (2013.01); *B22F 5/08* (2013.01); *B22F 5/10* (2013.01); *B22F 5/106* (2013.01); *B22F 7/062* (2013.01)

(58) Field of Classification Search
CPC ... B23P 11/02; B23P 11/005; Y10T 29/49908; Y10T 29/49925; Y10T 29/49927; Y10T 29/49934; Y10T 29/49945
See application file for complete search history.

(56) References Cited

U.S. PATENT DOCUMENTS

| | | | | |
|---|---|---|---|---|
| 6,101,713 | A | 8/2000 | May et al. | |
| 9,284,862 | B2 | 3/2016 | Frey | |
| 2003/0161585 | A1* | 8/2003 | Tung ..... | G02B 6/3833 385/78 |
| 2007/0271789 | A1* | 11/2007 | Kondo ..... | B21K 1/30 29/893 |

* cited by examiner

METHOD FOR PRODUCING A SINTERED PART WITH HIGH RADIAL PRECISION, AND SET OF PARTS COMPRISING JOINING PARTS TO BE SINTERED

This application represents the national stage entry of PCT International Application No. PCT/EP2014/002553 filed Sep. 19, 2014, which claims priority to German Patent Application No. 10 2013 015 677.7 filed Sep. 23, 2013, the disclosures of which are incorporated herein by reference in their entirety and for all purposes.

The present invention relates to a method for producing a sintered part with highly accurate radial precision. The invention also relates to a set of parts having sintered joining parts for joining of the sintered joining parts to form a sintered part with highly accurate radial precision.

A common method for the reworking of sintered parts is a calibration of a sintered part. Dimensional accuracy of the sintered part is imparted by way of a follow-up pressing process or a calibration. In the case of components provided for rotation, the calibration in many cases comprises, in particular, an imparting of dimensional accuracy of those surfaces which are oriented parallel to an axis of rotation of the sintered part. The calibration is performed under high pressure in a calibration die. In cases in which particular demands are placed on the dimensional accuracy of the sintered part, it is however in many cases still necessary, after this, for additional cutting machining steps to be performed, such as for example grinding, turning, milling or drilling. For this, it is however necessary to accept the disadvantage of the additional outlay associated with the further machining steps.

The invention is based on the object of being able to produce and provide a sintered part with highly accurate radial precision which, in terms of its characteristics and its production outlay, is improved in relation to the previously known sintered parts.

The object is achieved by way of a method for producing a sintered part with highly accurate radial precision, having the features of claim 1, and by way of a set of parts having sintered joining parts for joining of the sintered parts to form a sintered part with highly accurate radial precision, having the features of claim 10. Further advantageous refinements and developments will emerge from the following description. One or more features from the claims, from the description and from the figures may be combined with one or more features therefrom to form further refinements of the invention. In particular, it is also possible for one or more features from the independent claims to be replaced with one or more other features from the description and/or the figures. The proposed claims are to be regarded merely as a draft formulation of the subject matter, without restricting the latter.

A method for producing a sintered part with highly accurate radial precision is provided. The sintered part is produced at least from a first sintered joining part and a second sintered joining part. The method comprises at least the following steps:

- joining the first sintered joining part to the second sintered joining part,
- imparting the highly accurate radial precision, having a step of deforming at least one radial deformation element. The deformation of the radial deformation element is effected at least by way of a calibration tool. The deformation of the radial deformation element takes place at least substantially as a plastic deformation of the radial deformation element.

The expression "sintered part" refers in particular to the fact that the sintered part is a component which has already been subjected to a sintering process. It is preferably provided that no further sintering of the sintered part is required, though it may likewise be possible for further sintering of the sintered part to also be provided and/or necessary.

The expression "sintered joining part" likewise refers to an already-sintered component which is provided for joining to form a sintered part by way of joining to at least one further sintered joining part.

The expression "highly accurate radial precision" refers in particular to dimensional accuracy of a shell surface of the sintered part at least along a subsection of the axial extent of the sintered part oriented parallel to an intended axis of rotation of the sintered part.

In a preferred embodiment, the highly accurate radial precision is radial precision at at least one axial position of the axial extent of the sintered part.

In a particularly preferred embodiment of the method, the highly accurate radial precision is radial precision along the entire axial extent of the sintered part, wherein it is particularly preferable for the entire shell surface of the sintered part to have the highly accurate radial precision.

In a specific embodiment, the sintered part is a substantially rotationally symmetrical sintered part which has a shell surface corresponding to a shell surface of a circular cylinder. In this specific refinement, the highly accurate radial precision relates to an external diameter of the shell surface, wherein, for all external diameters within accepted tolerances, the diameter at every position of the axial extent of the sintered part exhibits its required dimensional accuracy.

The expression "highly accurate radial precision" refers in particular to precision in a radial direction of the sintered part with a tolerance of less than +/−0.050 mm in the radial direction, such that no extent deviates by more or less than 0.050 mm from its intended, dimensionally accurate value.

In a preferred development of the invention, it is provided that the highly accurate radial precision exhibits a tolerance of less than +/−0.025 mm, that is to say no deviation of an extent in the radial direction of more than 0.025 mm greater than or less than the intended, dimensionally accurate value arises. In a particularly preferred refinement of the invention, it is provided that the radial precision exhibits a tolerance of less than +/−0.015 mm, that is to say no extent deviates by more or less than 0.015 mm from its intended, dimensionally accurate value.

The expression "calibration tool" may refer firstly to a separate tool which is used to perform a calibration of a sintered part that has already been previously joined, in particular in another tool. It may however for example also be provided that the expression "calibration tool" refers to a region of a tool in which not only the calibration but also joining of the sintered part, at least the first sintered part and the second sintered part, has taken place. It may for example be provided that a progressive tool is used in which, in a sequential sequence, firstly a joining process and, in a further step, a calibration take place. It may likewise be provided, for example, that the joining and the calibration take place simultaneously at least at times, that is to say, for example, that the joining transitions into the calibration without a discrete transition. It may for example be provided that the step of the imparting of the highly accurate radial precision in a region of the calibration tool begins already at a point in time in which calibration is already taking place.

In a specific refinement of the method, it may for example be provided that the imparting of the highly accurate radial precision is imparted substantially by way of the deformation of the radial deformation element or of the radial deformation elements.

It may for example be provided that imparting of the highly accurate radial precision substantially by way of the deformation of the radial deformation element or of the radial deformation elements is understood to mean that at least 75% of the change in volume required for the imparting of the highly accurate radial precision is realized as a change in volume of the radial deformation element or of the radial deformation elements.

It may for example be provided that imparting of the highly accurate radial precision substantially by way of the deformation of the radial deformation element or of the radial deformation elements is understood to mean that at least 85% of the change in volume required for the imparting of the highly accurate radial precision is realized as a change in volume of the radial deformation element or of the radial deformation elements.

It may for example be provided that imparting of the highly accurate radial precision substantially by way of the deformation of the radial deformation element or of the radial deformation elements is understood to mean that at least 95% of the change in volume required for the imparting of the highly accurate radial precision is realized as a change in volume of the radial deformation element or of the radial deformation elements.

It may for example be provided that imparting of the highly accurate radial precision substantially by way of the deformation of the radial deformation element or of the radial deformation elements is understood to mean that at least 99% of the change in volume required for the imparting of the highly accurate radial precision is realized as a change in volume of the radial deformation element or of the radial deformation elements.

The change in volume relates in each case to the change in volume of the total volume of the sintered joining parts and of the radial deformation elements.

In a further refinement of the method, it may for example be provided that, during the course of the joining method step, an outer deformation part is positioned such that at least the first sintered joining part and/or at least the second sintered joining part are at least partially encircled by the outer deformation part. The outer deformation part then forms a radial deformation element in the form of an outer radial deformation element.

The expression "outer deformation part" refers to an independent component which, in addition to the first sintered joining part and the second sintered joining part, for example before the joining or during the joining of the first sintered joining part to the second sintered joining part, is positioned such that the first sintered joining part and/or the second sintered joining part are at least partially encircled. The expression "encircling of the first sintered joining part and/or of the second sintered joining part by the outer deformation part" refers to an arrangement in which the outer deformation part at least regionally encloses, surrounds and/or preferably lies in contiguous fashion against, a shell surface of the first sintered joining part and/or a shell surface of the second sintered joining part.

It is particularly preferably provided that the outer deformation part at least regionally lies against an edge at which the first sintered joining part and/or the second sintered joining part are joined.

An advantage of an arrangement of an outer deformation part is that, during the course of the imparting of the highly accurate radial precision, the degrees of freedom of the outer deformation part have the effect that it can adapt in a very effective manner to the calibration tool and can adopt the reference quality thereof with regard to the attitude and/or position tolerances and/or dimensional quality, that is to say in particular with regard to the radial precision.

In particular, it may be provided that the outer deformation part is composed of a material which is more easily deformable, in particular a material which is more easily plastically deformable, than the first sintered joining part and/or the second sintered joining part, such that the deformation of the outer deformation part takes place preferentially.

For the positioning of the outer deformation part, it may for example be provided that the outer deformation part is retained in an axial direction by a region of the first sintered joining part, which region has, in a radial direction, an extent greater than the extent of the outer deformation part, and/or that, in an axial direction, the outer deformation part is retained by a region of the second sintered joining part which has a region which has a radial extent greater than the radial extent of the outer deformation part. In particular, axial positioning of the outer deformation part can be realized by arrangement of at least one retention projection of the first sintered joining part and/or of at least one retention projection of the second sintered joining part.

In a refinement of the method, in which both the first sintered joining part and the second sintered joining part each have a corresponding retention projection, with a spacing of the projections in the joined state of the sintered part corresponding to an axial extent of the deformation part, exact positioning of the deformation part is imparted during the course of the joining process.

In another development of the method, it may for example be provided that an inner deformation part is positioned during the course of the joining process, and the inner deformation part at least partially covers:

- at least a first inner joining surface of the first sintered joining part, and/or
- at least a second inner joining surface of the second sintered joining part.

In a preferred refinement, the inner deformation part, which is positioned during the course of the joining process, completely covers

- the first inner joining surface of the first sintered joining part and/or
- the second inner joining surface of the second sintered joining part after the positioning process.

The inner deformation part then functions as a radial deformation element in the form of an inner radial deformation element.

An inner radial deformation element arranged on at least one inner joining surface has, inter alia, the advantage that exact positioning of the first sintered joining part relative to the second sintered joining part is promoted.

The expression "inner joining surface" refers to an inner shell surface of a recess, which is thus situated in an interior of the joined sintered part, wherein an interior is to be regarded as being characterized in that the interior is, at least in sections, encased by the outer shell surface. The expression "outer joining surface" refers to a shell surface of the elevation. The inner deformation part is situated at least regionally between an inner joining surface and an outer joining surface. It may however likewise also be provided that the inner deformation part extends over an entire axial extent of an inner joining surface and/or over an entire axial extent of an outer joining surface.

The positioning of the outer deformation part and/or of the inner deformation part during the course of the joining process is to be understood in the sense that, proceeding from the presence of the first sintered joining part, the second sintered joining part and the outer and/or inner deformation part, in order to produce a sintered part with highly accurate radial precision, the positioning of the inner and/or outer deformation part is performed. The positioning may for example be performed as a first step independently of the joining of the first sintered joining part to the second sintered joining part, for example by virtue of the deformation part being pushed over the sintered joining part or over the sintered joining parts or the deformation part being inserted into the sintered joining part or into the sintered joining parts. It may likewise be provided, for example, that the outer and/or the inner deformation part are/is positioned with a loose fit with frictional and/or non-positive engagement. It may likewise be provided that, at least in one part of the joining step, the joining of the outer and/or of the inner deformation part is also performed, that is to say that said process steps at least partially overlap.

A situation is encompassed in which a number of more than one inner deformation part and/or more than one outer deformation part are positioned during the course of the joining process.

In a further refinement of the method, it may for example be provided that one, more or preferably all of the deformation parts are, during the joining process, connected in frictionally engaging, positively locking, non-positively locking and/or cohesive fashion to one or more sintered joining parts.

In another refinement, it may for example be provided that, during the imparting of the highly accurate radial precision, one or more, preferably all, of the deformation parts are connected in frictionally engaging, positively locking, non-positively locking and/or cohesive fashion to one or more sintered joining parts.

In intermediate steps, it may likewise be provided that, at least at times during the method, at least part of the joining and at least part of the imparting of the highly accurate radial precision take place simultaneously. It may likewise be provided, for example, that the at least one deformation part is connected to one or more sintered joining parts while the joining and the imparting of the highly accurate radial precision are each at least partially performed simultaneously.

At least partially simultaneous performing of the joining and of the imparting of the highly accurate radial precision has the advantage that the process duration is reduced, and greater accuracy in terms of radial precision and in particular in terms of the radial positioning of the sintered joining parts relative to one another can be achieved.

In a further refinement of the method, it may for example be provided that

- at least one region of at least one inner joining surface of the first sintered joining part, and/or
- at least one region of at least one inner joining surface of the second sintered joining part, and/or
- at least one region of at least one outer joining surface of the first sintered joining part, and/or
- at least one region of at least one outer joining surface of the second sintered joining part has at least one radial elevation which forms a radial deformation element in the form of an inner radial deformation element.

The expression "radial elevation" refers to an elevation which protrudes out of the first sintered joining part and/or out of the second sintered joining part and which is preferably an integral constituent part of the sintered joining part and which is at least partially elevated in a radial direction. An advantage of such a refinement of an elevation consists in that the radial elevation can be formed into a green part, which will later become the sintered joining part as a result of the sintering process, already during the powder pressing process for producing said green part. It is thus possible for the radial elevation to be formed into the subsequent sintered joining part for example by way of negative reproduction in a press die.

A radial elevation is an elevation which has, at least inter alia, an extent component in a radial direction. For example, the radial elevation may be a linear elevation, which has the advantage that such a linear elevation can be reproduced particularly easily during the pressing of powder for the production of a green part which will later become the sintered joining part. It may however likewise also be provided, for example, that the elevation involves for example a stud or some other geometrical shape.

The presence of a radial elevation has the advantage that, during joining of the individual parts, for example of the first sintered joining part and of the second sintered joining part, the individual parts are oriented at the contact surfaces with respect to the tool elements of the joining tool and/or of the calibration tool. Precise manufacture and position tolerances of the tool parts with simultaneously stable tool design then has the effect, if more than one elevation is provided, that dimensional deviations of the sintered joining parts are compensated by locally different degrees of deformation within the elevations. As a result of the presence of the elevations, even a slight radial deviation from the optimum position leads to an exceedance of the flow stress in the contact zone. In this way, as a result, even in the presence of small deviations and the resulting small pressures that arise, a plastic deformation in particular of the elevations is caused. At the same time, the material of the sintered joining part which has elevations can flow into a cavity which is situated between at least one first and one second elevation. The presence of at least one elevation consequently leads to a highly accurate possible orientation at least of the first sintered joining part and of the second sintered joining part relative to one another.

It is particularly preferable for a refinement of the method to be provided in which a number of at least two elevations is provided. It is particularly preferable for a number even greater than two elevations to be formed on so as to be arranged, preferably uniformly, over an entire circumference. It may likewise be provided, for example, that elevations are provided both on the first sintered joining part and on the second sintered joining part.

A further refinement of the method provides that the imparting of the highly accurate radial precision is performed at least partially simultaneously with the joining of the first sintered joining part and of the second sintered joining part. It may for example be provided that joining of the first sintered joining part and of the second sintered joining part and imparting of the highly accurate radial precision are performed in succession by way of a progressive tool, such that the transition of joining of the first sintered joining part and of the second sintered joining part into the imparting of highly accurate radial precision takes place only on the basis of the position of the first sintered joining part and of the second sintered joining part, wherein a continuous transition or a discontinuous transition may be provided.

A further refinement of the method may for example provide that for the joining, at least one first process step is performed by way of at least one joining tool, and/or, for the imparting of the highly accurate radial precision, at least one second process step is performed by way of a calibration tool in the form of a separate calibration tool and/or by way of a calibration tool in the form of a calibration region of a combined progressive tool.

Such a refinement of the method for producing a sintered part with highly accurate radial precision has the advantage that the calibration tool can be adjusted and/or exchanged independently of the tool used for the joining process, whereby greater flexibility is realized.

A further embodiment of the method for producing a sintered part with highly accurate radial precision may for example provide that, after the imparting of the highly accurate radial precision, the sintered part with highly accurate radial precision is removed from the calibration tool. It is thus provided that said sintered part is removed as a sintered part with highly accurate radial precision.

One of the advantages of the sintered part being removed from the calibration tool as a sintered part with highly accurate radial precision is that the desired highly accurate radial precision exists immediately after the calibration process. This yields the advantage that the reproducibility of the diameter dimension and the quality of the reference and dimensional characteristics after the plastic deformation or after the calibration no longer need to be improved by reworking. In particular, it is for example also the case that no cutting machining, for example of the diameter, of the shell surfaces and/or of the reference surfaces and functional surfaces, is required; that is to say, for example, further grinding, turning, milling and/or drilling is no longer necessary. This yields the considerable advantage of less time-consuming, material-intensive and work-intensive production of the sintered parts.

In one refinement of the method, the method includes the first sintered joining part and the second sintered joining part being pressed against one another under the action of an axial pressing force exerted by way of a pressing tool. Here, the highly precise molded part height is effected as a result of the pressing against one another.

The expression "joining surface" refers here to a side in relation to which, in the case of a sintered part provided for a rotational movement, the axis of rotation is oriented perpendicular or at least substantially perpendicular. The expression "joining surface" in this case also encompasses elevations or depressions. It is thus not necessary for a joining surface to be in the form of an entirely planar surface.

The expression "highly precise molded part height" is to be understood to mean that the sintered part has a molded part height which allows for immediate use of the sintered part for its intended purpose. In particular, it is provided that mechanical reworking, for example by way of cutting machining, in particular for example grinding or turning, is no longer necessary.

The pressing of the first sintered joining part and of the second sintered joining part against one another by way of a pressing tool is to be understood to mean that an axial contact pressure is exerted on at least one of the sintered joining parts. Here, the pressing tool need not necessarily be the same tool used to perform a joining process. The imparting of an axial contact pressure is not to be understood to mean that pressure is exerted directly on one or both of the first and second sintered joining parts; rather, it may likewise be provided that, for example, more than two sintered joining parts are joined and only one out of the first sintered joining part and second sintered joining part, or else neither of the first sintered joining part and second sintered joining part, comes into direct contact with the pressing tool. The expression "pressing . . . against one another" encompasses in particular, in a joined state of the sintered part, a stamping of the sintered part, that is to say an exertion of pressure in an axial direction in order to realize the intended height dimension.

In a refinement of the invention, it may be provided in particular that the molded part height has a tolerance of less than +/−0.05 mm, that is to say the spacing of the face sides of the sintered part is less than 0.05 mm greater than or less than the intended value.

In a preferred refinement of the invention, it is provided that the molded part height has a tolerance of less than +/−0.025 mm, that is to say the spacing of the face sides of the sintered part is less than 0.025 mm greater than or less than the intended value.

In a particularly preferred refinement of the invention, it is provided that the molded part height has a tolerance of less than +/−0.015 mm, that is to say the spacing of the face sides of the sintered part is less than 0.015 mm greater than or less than the intended value.

In one development of the method, it may be provided that the first sintered joining part has at least one first deformation element arranged on the first joining surface and/or the second sintered joining part has at least one second deformation element arranged on the second joining surface. It is for example provided that a deformation of at least one of the deformation elements is effected by way of the pressing against one another.

The expression "deformation element" may for example refer to an elevation which is provided integrally in the first sintered joining part as a first deformation element and/or in the second sintered joining part as a second deformation element.

A further refinement of the method may for example provide that the first deformation element arranged on the first joining surface is inserted into a first receiving depression arranged on the second joining surface. It may likewise be provided that at least the second deformation element arranged on the second joining surface is inserted into a second receiving depression arranged on the first joining surface. It is achieved in this way that positioning of the deformation elements in a direction oriented perpendicular to the axial direction is effected.

It may for example be provided that the joining, the imparting of the highly accurate radial precision and the stamping are performed in the same process step.

It may likewise be provided, for example, that joining is performed as a first step, and then stamping and/or imparting of the highly accurate radial precision are/is performed as a further step, such that the joining and the stamping are performed as sequential process steps.

It may likewise be provided, for example, that the joining transitions continuously into the stamping and/or into the imparting of the highly accurate radial precision, by virtue of the two process steps being performed in the same tool.

The sequence and configuration of the transition and/or of the overlap of the method steps of joining, stamping and/or imparting of the highly accurate radial precision may be performed in any desired sequence.

Another concept of the invention, which may be pursued independently or in combination with the other concepts of the invention, relates to a set of parts having sintered joining parts for joining of the sintered joining parts to form a sintered part with highly accurate radial precision.

The set of parts has at least the following:

a first sintered joining part, a second sintered joining part and a radial deformation element.

The first sintered joining part and the second sintered joining part are in each case a sintered part which has, for example, a sintered steel, a sintered metal or a sintered ceramic. The first sintered joining part and/or the second sintered joining part are/is preferably each also a component which are/is composed entirely of a sintered metal, of a sintered steel or of a sintered ceramic. The expression "sintered joining part" is to be understood to mean that the first sintered joining part is suitable and provided for being joined to the second sintered joining part to form a sintered part or to form a part of a sintered part.

It may therefore also be provided, for example, that for joining of the sintered part, one or more further components are additionally provided or, for example, may also be used or are necessary. Such further components may for example be further sintered joining parts; they may however likewise also be, for example, deformation parts which are provided in addition to the sintered joining parts and which form one or more radial deformation elements.

It may therefore be provided that the set of parts has not only the first sintered joining part and the second sintered joining part but also any desired further number of sintered joining parts or other components.

The expression "radial deformation element" refers to an element which is provided for a deformation in a radial direction. A radial direction refers to a direction which is perpendicular or at least substantially perpendicular to an axial direction of the sintered part. By contrast, this is not necessarily intended to imply that the sintered part has to be a rotationally symmetrical part. Rather, in the case of sintered parts provided for rotation or partial rotation, an axial direction lies on the axis of rotation.

For the specific case of a rotationally symmetrical component or of a substantially rotationally symmetrical component, an axial direction lies on the axis of symmetry.

The radial deformation element may for example be an element which is connected integrally to the sintered joining part. It may however likewise also be provided that the radial deformation element is a separate element which is applied to the first and/or to the second sintered joining part before or during the joining of the sintered part.

In a refinement of the set of parts, it may for example be provided that the set of parts has an inner deformation part which is, during the course of the joining process, positionable so as to at least partially cover at least a first inner joining surface of the first sintered joining part and/or so as to at least partially cover at least a second inner joining surface of the second sintered joining part, and forms a radial deformation element in the form of an inner radial deformation element.

It may for example be provided that, in addition to a covering configuration, at least partial or complete shrouding is realized, which refers to contact of the inner deformation part with the first inner joining surface and/or with the second inner joining surface.

The expression "inner radial deformation element" refers to a radial deformation element which, during the joining process, is, at least over a part of its axial extent, encircled at least by a part of the first sintered joining part and/or at least by a part of the second sintered joining part, such that, in the finished, joined sintered part, the inner radial deformation element is situated at least partially in an interior of the sintered part.

In another refinement of the set of parts, it may for example be provided that the set of parts has an outer deformation part which is, during the course of the joining process, positionable so as to at least partially encircle at least the first sintered joining part and/or so as to at least partially encircle at least the second sintered joining part, and forms a radial deformation element in the form of an outer radial deformation element.

The expression "outer radial deformation element" refers to a radial deformation element of said type which, during the joining and after the joining, that is to say then in the joined sintered part, forms, by way of a part of its surface, at least a part of the shell surface of the sintered part.

For example, it may be provided that the first sintered joining part and/or the second sintered joining part are sintered joining parts which, at least in sections, have an approximately ring-shaped or ring-shaped cross section, and that, furthermore, the outer radial deformation element is in the form of a ring. It may for example be provided that the radial deformation element in the form of a ring has an internal diameter which substantially corresponds to the external diameter of the first sintered joining part and/or of the second sintered joining part, such that the outer deformation part in the form of a ring can be arranged so as to at least partially encircle the sintered joining parts and, in this way, forms a radial deformation element in the form of an outer radial deformation element.

In a further refinement of the set of parts, it may for example be provided that the first sintered joining part has a first radial retention projection and/or the second sintered joining part has a second radial retention projection for the axial positioning of the outer deformation part in the joined state of the sintered part.

The radial retention projection is a radial extents which, at least over an angle range of the sintered joining part, extends in a radial direction beyond radial extents which are provided at other axial positions of the sintered joining part, which have the effect that an outer deformation part which is positioned in an at least partial encircling arrangement of the first sintered joining part and/or the second sintered joining part is positioned by the projections in an axial direction.

In a further development of the set of parts, it may for example be provided that at least one region of at least one inner joining surface of the first sintered joining part, at least one region of at least one inner joining surface of the second sintered joining part, at least one region of at least one outer joining surface of the first sintered joining part, and/or at least one region of at least one outer joining surface of the second sintered joining part has at least one radial elevation in the form of an inner radial deformation element.

It may for example be provided that the radial elevation gives rise to an interference fit during the joining process.

The expression "inner radial deformation element" encompasses a situation wherein, in the joined state of the sintered part, the inner radial deformation element is situated in the interior of the sintered part. A radial elevation is in particular characterized in that it is formed out of the material of one or more of the sintered joining parts and is formed integrally with the sintered joining part or with the sintered joining parts. The provision of a radial elevation yields the advantage that, owing to the reduction in contact area between the first sintered part and the second sintered part during the joining process, the positioning of the first sintered part in relation to the second sintered part is also considerably improved as a result of the plastic deformation of the radial elevation which is effected more easily during the joining process.

A further refinement of the set of parts may for example have one or more radial elevations formed with one of the following geometric shapes: spherical section, truncated spherical section, truncated cone, cuboid, truncated trapezoid, truncated pyramid or linear elevation.

If a radial elevation is in the form of a linear elevation, it is preferably provided that the radial elevation is oriented in a direction which is oriented parallel to an axial direction of the first sintered joining part and/or to an axial direction of the second sintered joining part. By virtue of the radial elevation being formed as a linear elevation which is oriented in a direction parallel to an axial direction of the first sintered joining part and/or in a direction parallel to an axial direction of the second sintered joining part, has the advantage that, during the course of the production of the first sintered joining part and/or of the second sintered joining part by way of the pressed part and/or the green part being axially pressed into a correspondingly shaped die, particularly advantageous production of the sintered joining part is possible.

In a further development of the set of parts, it may for example be provided that

- a minimum extent of an upper contact surface of 0.2 mm in at least one dimension of the contact surface,
- an extent of a base surface of the base surface of 0.4 mm to 2.0 mm in at least one dimension, and/or
- a height of 0.1 mm to 2.0 mm between the base surface and the contact surface.

A design of the elevation in accordance with the above-stated values has proven to be particularly advantageous in that the elevation contains a volume of material sufficient to allow, by way of plastic flow of material of the elevation, adequate positioning of the first sintered joining part relative to the second sintered joining part. Furthermore, however, at the same time, the cavity that arises between the first sintered joining part and the second sintered joining part is small enough that, for example, it can be closed by plastic deformation and/or does not oppose correct functioning of the sintered part.

In a further refinement of the set of parts, it may for example be provided that the sintered part with highly accurate radial precision is a rotor for a camshaft adjuster, a pump ring, an oil pump housing, a stator or a shock-absorbing damper piston.

Also provided is a use of a set of parts for realizing joining to form a sintered part with highly accurate radial precision, wherein the sintered part with highly accurate radial precision can be removed from a calibration tool. It is preferable for the use of one of the methods discussed above to be provided for the joining to form the sintered part.

Further advantageous developments and refinements will emerge from the following figures. The details and features that emerge from the figures are however not restricted thereto. Rather, one or more features may be combined with one or more features from the above description to form new refinements. In particular, the following statements do not serve to restrict the respective scope of protection, but rather discuss individual features and the possible interaction thereof with one another.

Figure 1:
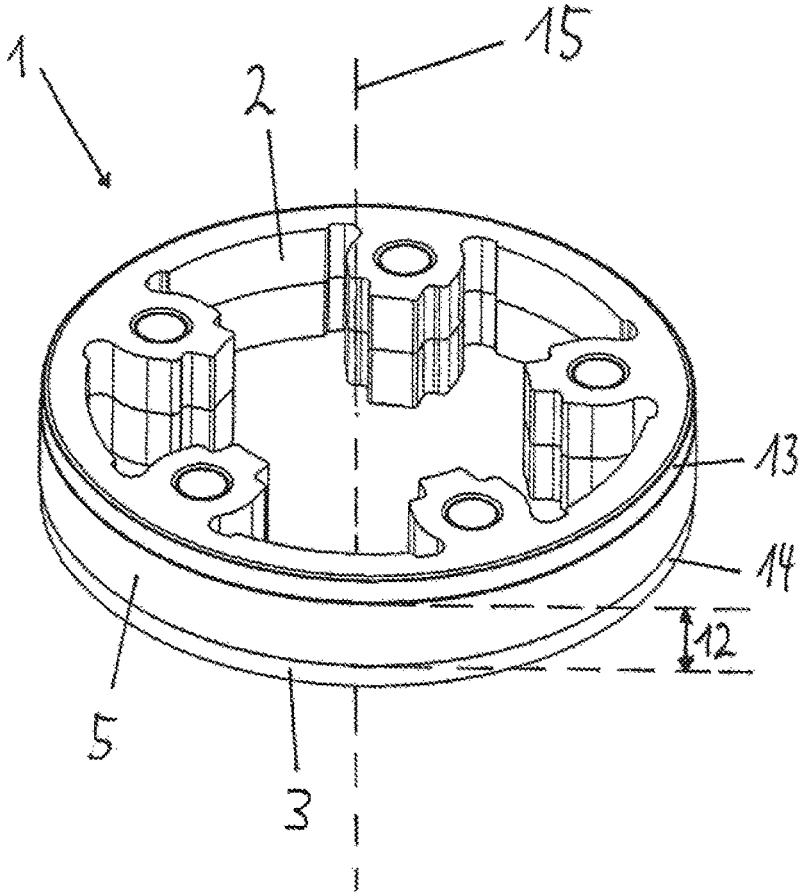
FIG. 1 shows an exemplary refinement of a sintered part as a stator composed of a sintered joining part and of a second sintered joining part and of a radial deformation element in the form of an outer deformation part.

FIG. 1 shows an exemplary refinement of a sintered part 1 in an oblique view. The sintered part 1 is a stator of a camshaft adjuster. The sintered part 1 has a first sintered joining part 2 and a second sintered joining part 3 which have been joined together. Furthermore, the sintered part 1 has an outer deformation part 5 which forms a radial deformation element in the form of an outer radial deformation element. The outer deformation part 5 is, in the refinement shown, in the form of a ring. The axial extent 12 of the outer deformation part 5 corresponds to a spacing of a first radial retention projection 13 of the first sintered part from a second radial retention projection 14, wherein, in the refinement shown, the first radial retention projection 13 and the second radial retention projection 14 are also of rotationally symmetrical form with respect to the axis of rotation 15 of the sintered part 1. The first radial retention projection and the second radial retention projection 14 effect axial positioning of the outer deformation part 5. The radial extent of the outer deformation part 5 is, at all points, greater than the radial extent both of the first sintered joining part 2 and of the second sintered joining part 3. It is realized in this way that, during the calibration, a plastic flow of the outer deformation part makes a significant contribution to the imparting of the highly accurate radial precision.

Figure 2:
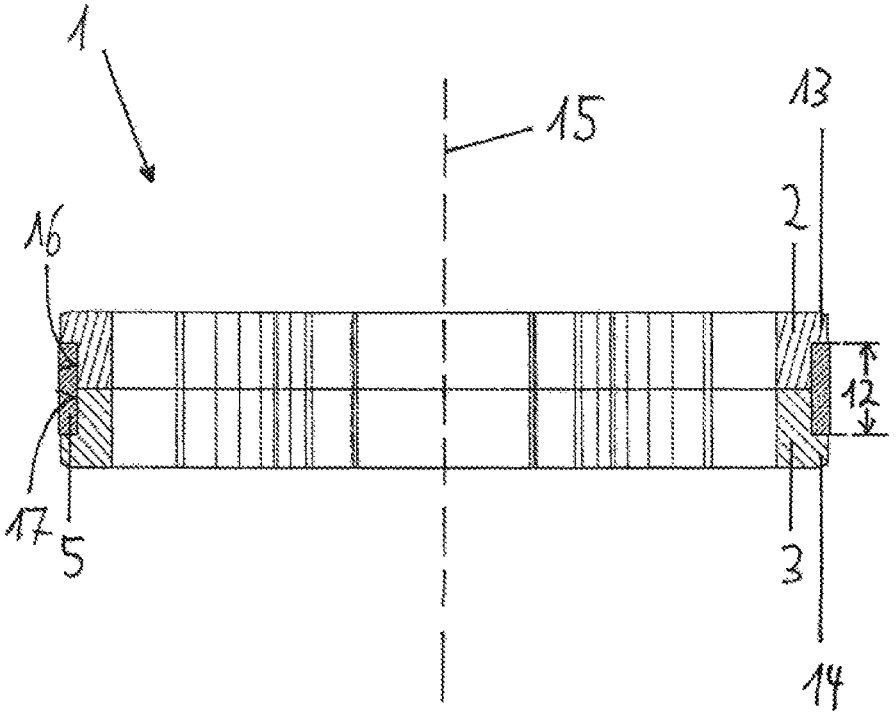
FIG. 2 shows an exemplary refinement of a sintered part as a stator composed of a sintered joining part and of a second sintered joining part and of a radial deformation element, in the form of an outer deformation part, in cross section.

FIG. 2 shows a cross-sectional illustration, encompassing the axis of rotation 15, of the refinement, shown in FIG. 1, of a sintered part 1 with highly accurate radial precision.

Figure 3:
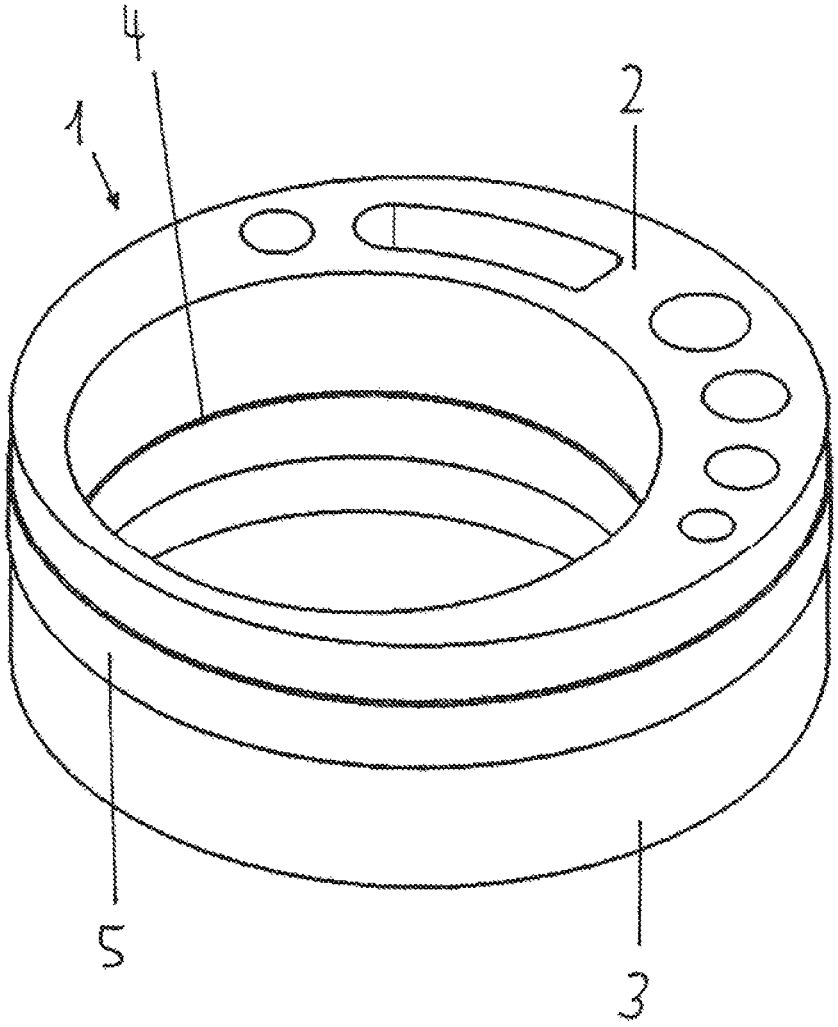
FIG. 3 shows an exemplary refinement of a sintered part as an oil pump housing composed of a first sintered joining part, of a second sintered joining part and of a visible radial deformation element in the form of an outer radial deformation element.

FIG. 3 shows a further exemplary refinement of a sintered part 1 in an oblique view. The exemplary refinement in FIG. 3 is an oil pump housing which has a first sintered joining part 2 and a second sintered joining part 3. Furthermore, the sintered part 1 of FIG. 3 has an outer deformation part 5 which is in the form of a ring. The outer deformation part 5 in the form of a ring fully encircles the first sintered joining part 2 and is formed so as to bear against a partial region of the outer shell surface of the first sintered joining part 2. FIG. 3 likewise shows an inner deformation part 4, which is likewise in the form of a ring.

Figure 4:
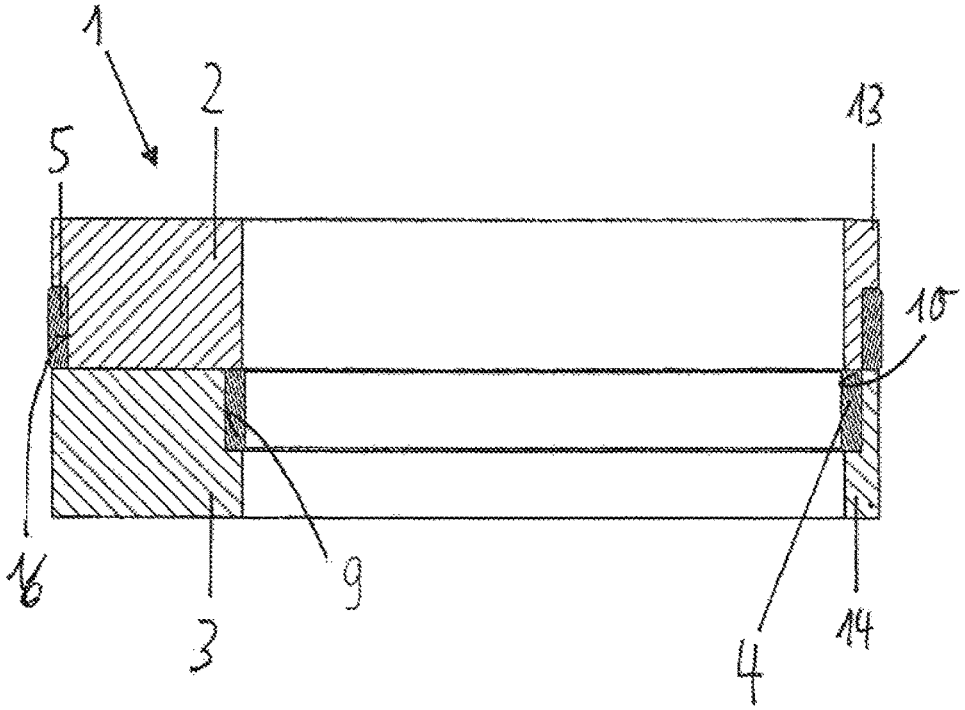
FIG. 4 shows an exemplary refinement of a sintered part as an oil pump housing composed of a first sintered joining part, of a second sintered joining part and of a visible radial deformation element, in the form of an outer deformation element, in cross section, also illustrating a radial deformation element in the form of an inner deformation part.

FIG. 4 shows a cross-sectional illustration of the sintered part illustrated in FIG. 3. In addition to the features of the sintered part 1 that already emerge from the illustration of FIG. 3, the illustration shown in FIG. 4 also shows a first retention projection 13 which, together with the second sintered joining part 3, effects axial positioning of the outer deformation part 5. Furthermore, the cross-sectional illustration of FIG. 4 shows an inner deformation part 4 inserted in the interior of the sintered part 1. In the illustration shown, the inner deformation part 4 is likewise in the form of a ring and is inserted in a recess of the second sintered part 3. The dimensions and the geometric design of the ring are such that the inner deformation part 4 completely covers a second inner joining surface 9 of the second sintered joining part 3 over the entire part of its axial extent. The inner deformation part 4 completely covers a first outer joining surface 10 of the first sintered joining part over the entire part of its axial extent. In the refinement shown, the inner deformation part 4 is arranged between the first outer joining surface 10 and the second inner joining surface 9 with an interference fit. By way of the illustrated arrangement of the inner deformation part, it is realized that axial positioning of the first sintered joining part 2 relative to the second sintered joining part 3 with high accuracy is realized as a result of the plastic deformation of the inner deformation part 4, which functions as inner radial deformation element. Axial positioning of the inner deformation part is realized by way of the second retention projection 14, which is formed in the recess of the second sintered joining part.

Figure 5:
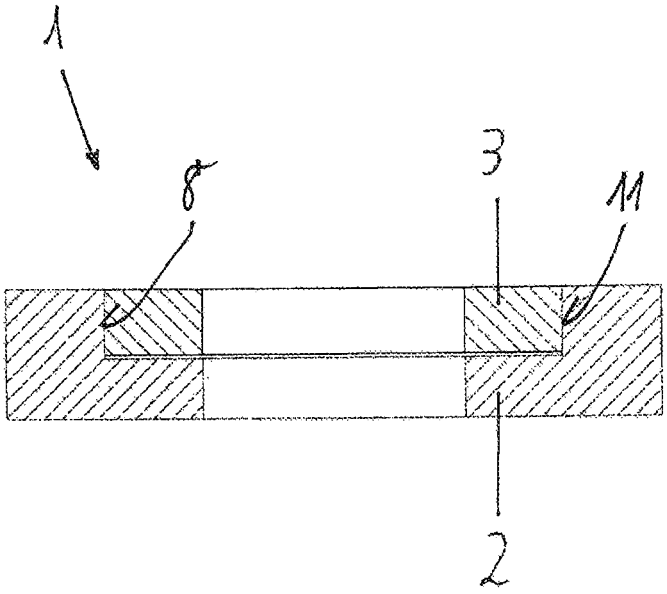
FIG. 5 shows an exemplary refinement of a sintered part composed of a first sintered joining part and of a second sintered joining part with a radial deformation element, in the form of a radial elevation, in cross section.

FIG. 5 shows a further exemplary refinement of a sintered part 1. The sintered part 1 illustrated in FIG. 5 is a sintered part 1 formed from a first sintered joining part 2 and from a second sintered joining part 3 by joining. The first sintered joining part 2 has a recess, the inner shell surface of which forms a first inner joining surface 8. The second sintered joining part 3 has been inserted into the recess. An in particular frictionally engaging connection of the two sintered joining parts has been effected by way of inner radial deformation elements, which are in the form of radial elevations 6 and which are arranged on a second outer joining surface 9 of the second sintered joining part and which are plastically deformed during the insertion of the second sintered joining part 3 into the recess of the first sintered joining part.

Figure 6:
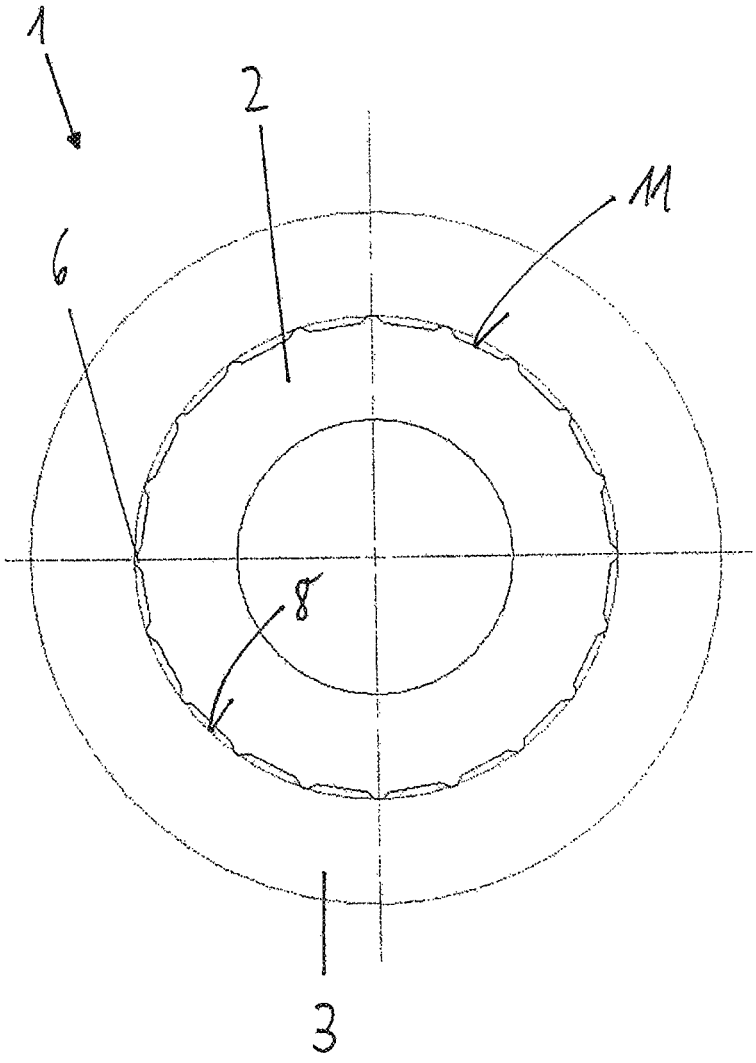
FIG. 6 shows an exemplary refinement of a sintered part composed of a first sintered joining part and of a second sintered joining part with a radial deformation element, in the form of a radial elevation, in a plan view.

While the stated radial elevations cannot be seen in the illustration of FIG. 5, they can be seen in the plan-view illustration of FIG. 6.

The invention claimed is:

1. A method for producing a sintered part with highly accurate radial precision, wherein the sintered part is produced from at least a first sintered joining part and a second sintered joining part, the method comprising at least the following steps:

joining the first sintered joining part with the second sintered joining part, imparting the highly accurate radial precision, having a step of deforming at least one radial deformation element, wherein the deformation of the radial deformation element is effected at least by way of a calibration tool and takes place at least substantially as a plastic deformation of the radial deformation element, wherein an outer deformation part is, during the course of the joining process, positioned so as to at least partially encircle at least the first sintered joining part and the outer deformation part forms a radial deformation element in the form of an outer radial deformation element.

2. The method as claimed in claim 1, wherein an inner deformation part is, during the course of the joining process, positioned so as to at least partially cover at least a first inner joining surface of the first sintered joining part and/or so as to at least partially cover at least a second inner joining surface of the second sintered joining part, and the inner deformation part forms a radial deformation element in the form of an inner radial deformation element.

3. The method as claimed in claim 1, wherein the outer deformation part is, during the joining process, connected in at least one of frictionally engaging, positively locking, non-positively locking and cohesive fashion to at least one of the sintered joining parts, and/or wherein the outer deformation part is, during the imparting of the highly accurate radial precision, connected in at least one of frictionally engaging, positively locking, non-positively locking and cohesive fashion to at least one of the sintered joining parts.

4. The method as claimed in claim 1, wherein the imparting of the highly accurate radial precision is performed at least partially at the same time as the joining of the first sintered joining part and of the second sintered joining part.

5. The method as claimed in claim 1, wherein for the joining, at least one first process step is performed by way of at least one joining tool, and/or, for the imparting of the highly accurate radial precision, at least one second process step is performed by way of a calibration tool in the form of a separate calibration tool and/or by way of a calibration tool in the form of a calibration region of a progressive tool.

6. The method as claimed in claim 1, wherein after the imparting of the highly accurate radial precision, the sintered part is removed from the calibration tool as a sintered part with highly accurate radial precision.

7. The method as claimed in claim 1, wherein for the production of the sintered part, a first joining surface of the first sintered joining part and a second joining surface of the second sintered joining part are pressed against one another under the action of an axial pressing force exerted by way of a pressing tool, wherein the first sintered joining part has at least one first deformation element arranged on the first joining surface and/or the second sintered joining part has at least one second deformation element arranged on the second joining surface, and a deformation of at least one of the deformation elements is effected by way of the pressing against one another.

8. The method as claimed in claim 1, wherein the at least one radial deformation element is positioned adjacent to a joining contact zone.

9. The method as claimed in claim 1, wherein at least 75% of a change in total volume of the sintered parts and the at least one radial deformation element by way of the deforming is realized as a change in volume of the at least one radial deformation element.

10. A method for producing a sintered part with highly accurate radial precision, wherein the sintered part is produced from at least a first sintered joining part and a second sintered joining part, the method comprising at least the following steps:

joining the first sintered joining part with the second sintered joining part, imparting the highly accurate radial precision, having a step of deforming at least one radial deformation element, wherein the deformation of the radial deformation element is effected at least by way of a calibration tool and takes place at least substantially as a plastic deformation of the radial deformation element, wherein at least one region of at least one inner joining surface of the first sintered joining part has at least one radial elevation which forms a radial deformation element in the form of an inner radial deformation element.

* * * * *